United States Patent [19]

Di Fronzo

[11] 4,223,056

[45] Sep. 16, 1980

[54] WEIGHTED SERVICE CLOTH

[76] Inventor: Antonio Di Fronzo, 8633 N. Keystone, Skokie, Ill. 60076

[21] Appl. No.: 14,067

[22] Filed: Feb. 22, 1979

[51] Int. Cl.[2] ..... A41D 31/02; B65D 81/00; B32B 33/00

[52] U.S. Cl. ..... 428/52; 2/DIG. 6; 428/82; 428/88; 428/91; 428/99; 428/100; 428/128; 428/223

[58] Field of Search ..... 2/69.5, 111, DIG. 6; 428/40, 52, 82, 88, 91, 99, 100, 128, 223, 188, 85

[56] References Cited

U.S. PATENT DOCUMENTS

| | | | |
|---|---|---|---|
| 4,069,781 | 1/1978 | Andersson | 2/DIG. 6 |
| 4,104,742 | 8/1978 | Rahaim | 2/DIG. 6 |
| 4,140,253 | 2/1979 | Vickers et al. | 2/DIG. 6 |

*Primary Examiner*—Harold Ansher
*Attorney, Agent, or Firm*—Carl C. Batz

[57] ABSTRACT

A service cloth having on its top side patches of hook fiber cloth, and bags containing weight material, each of the bags having on one side thereof a patch of hook fiber cloth, the hook fibers of the patches on the bags being pressed into intermeshing and interlocking engagement with the fibers of the patches on the top of the service cloth, the hook fibers being yieldable and resilient to permit such engagement and to permit disengagement upon the application of sufficient force. Also the provision of a flap portion of the service cloth which is foldable over the body of the cloth and attachable, in the same manner, to provide a pocket.

3 Claims, 3 Drawing Figures

WEIGHTED SERVICE CLOTH

This invention relates to a service cloth having weights to hold it in place and, more particularly, to such a service cloth having weight elements which are detachable and may be easily engaged or disengaged from the service cloth.

Towels are commonly used at the seashore, particularly on sandy beaches. The towels provide a place on which bathers may lounge and keep their accessories free from sand, reducing the danger of losing small articles in the sand.

A difficulty in the use of beach towels is that they do not stay in place. Because of wind and other influences the towel may wrinkle, double up, or get into all sorts of undesirable shapes.

Instead of a towel, the service cloth may be in the form of a table cloth or a blanket to be placed on the ground, and it is desirable to weight the edge portions of the cloth to keep the cloth from sliding off the table or to be moved out of position in some way.

Where it is desirable to weight a service cloth, the usual practice is to enclose a lead disc in the hem at the edge of the cloth, or to place such a unit weight in someway in a pocket formed by the cloth where it is attached in a permanent fashion. What is needed is some way to provide a towel or other service cloth which can serve its normal function and be transported without distortion and having provision for easily attaching and detaching a substantial weight at a location where the service cloth is to be used. I have set myself to the provision of such an improved service cloth.

DISCLOSURE OF THE INVENTION

Figure 1:
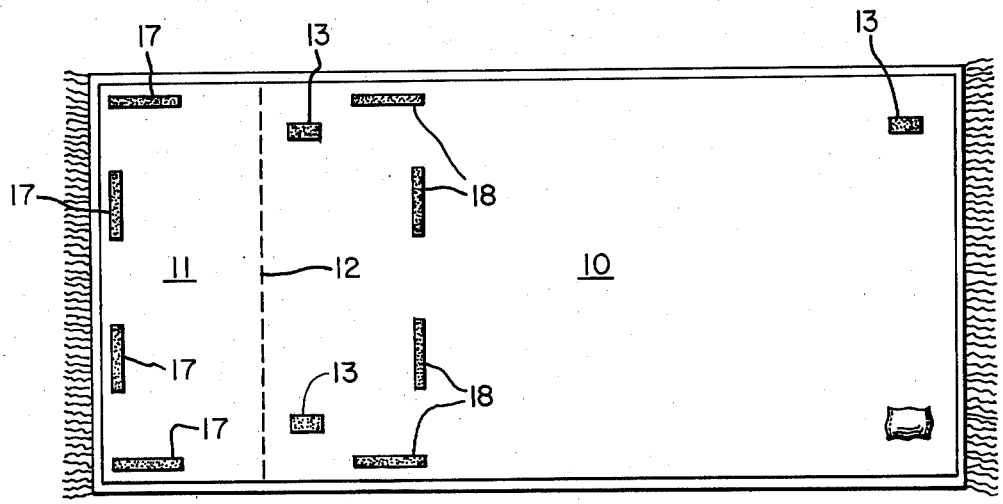
Figure 2:
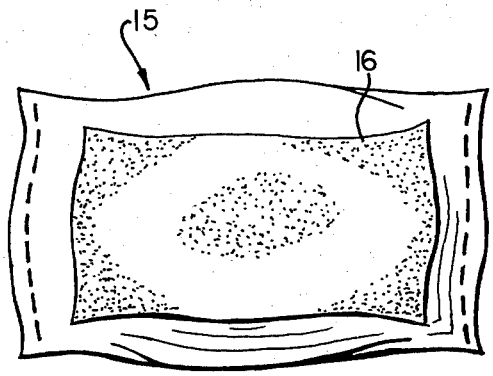
Figure 3:
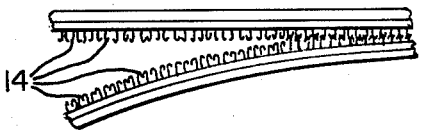

One embodiment of my invention is illustrated in the accompanying drawing in which FIG. 1 is a plan view of an improved beach towel showing the weight in place at one corner of the towel;

FIG. 2 is an enlarged view of the underside of a weight bag showing a patch on its underside; and FIG. 3 is a schematic broken detail sectional view of the service cloth taken at the place where a weight bag is attached, showing the manner in which the bag is detachably secured to the service cloth.

As illustrated, there is shown in FIG. 1 a beach towel 10 which is rectangular in form. One end of the towel is extended to form a flap portion 11 which is foldable across the top of the towel about the line 12 to form a pocket under the flap portion.

Patches of hook fiber cloth 13 are secured to the top side of the towel 10 by being sewed to the towel or by other suitable means of attachment. The hook fiber cloth of which patches 13 are made is a type of fabric having plastic fibers extending from one side of the cloth, these fibers being turned at their outer ends to provide hooks 14 (see FIG. 3). The plastic fibers are resilient which permits them to yield when pressed together but to resume their original hook form when pressure is relieved. Thus when the fibers of one piece of hook cloth are pressed into the fibers of another piece of this cloth, the hooks mesh together resulting in the hooks of the fibers on one piece engaging the hooks of fibers on the other piece to secure the pieces together. However, the pieces may be detached by pulling them apart with sufficient force, requiring the hook portions of the fibers to be distorted and then after separation of the pieces, the fibers again assume their original form.

The hook fiber type of cloth is being manufactured and sold in the United States, one such cloth being distributed and sold under the trakemark VELCRO.

As illustrated, patches 13 are rectangular in form and are located generally at the corners of the towel, the two spaced patches shown at the left-hand end, as seen in FIG. 1, being attached at a portion of the towel which is under the flap 11.

FIG. 2, which is enlarged with respect to the dimensions of FIG. 1, shows a bag 15 made of cloth or other suitable material. This material may be in the form of a tube and contains pellets of lead, stones, or other such weight material. Preferably the weight is in particular form like small pebbles so that the side of the bag may easily accommodate either a flat or irregular surface as may be required. The tube material from which the bag is made may be sewed at its ends to contain the weight material. FIG. 2 shows the bottom side of the bag, and the patch 16, which is generally of the same size as are patches 13, is attached by sewing or in other suitable manner to the bag 15.

Patches 17 made of hook fiber cloth as described in connection with patches 13, are attached in spaced arrangement to the foldable portion 11 near the edges of this portion, and patches 18, also made of hook fiber cloth, are attached to the top side of the towel at positions where they will register with patches 17 when the flap is turned over the towel about the line of fold 12.

In the use of the improved beach towel a person may carry the towel along with a number of bags 15 to the beach and spread the towel into the form shown in FIG. 1. Then the person may place a bag 15, bottom side down, against each of patches 13 as shown at the lower right-hand corner of FIG. 1, pressing the bag against the patch to cause the hook fibers of the patch 17 attached to the bag to mesh with and lock with the hook fibers of the patches 13 on the top of the towel. In this way weight bags are attached to each of the patches 13.

If desired, the person may place accessories or articles of various kinds on the towel in the vicinity of the line of fold 12, and fold the flap 11 over it, pressing the patches 16 against the patches 17 with which they are in register. We may note that the bags which lie under the foldover flap are not even seen. In this condition, the towel is held positively against displacement due to wind or other currents and the articles under the flap are effectively contained.

When it is desired to leave the beach, the person using the towel may use the necessary force to lift flap 11 against the holding power of patches 17, recover the articles which were contained under it, then forceably lift each of the bags 15 to separate patches 16 from patches 17, collecting the bags for use on another occasion, gather up the towel which is then free from weights, and remove it from the beach area.

While I have illustrated and described in detail only one embodiment of my invention, it will be apparent to those skilled in the art that other embodiments may be made, and many changes may be made, all within the spirit of the invention and the scope of the appended claims.

What is claimed:

1. A service cloth having patches of hook fiber cloth secured to the service cloth on its top side, bags containing weights, each of said bags having secured thereto on one side thereof a patch of hook fiber cloth, the hook fibers of the cloth on said bag being detachably engaged in hooked relation with the hook fibers of the cloth of said patches whereby said bags are detachably secured to the service cloth.

2. A service cloth as set forth in claim 1 and in which said service cloth is generally rectangular in form, said patches being located in the general area of the four corners of the service cloth.

3. A service cloth as set forth in claim 1 in which the service cloth is extended at one end to form a fold-over flap which is foldable over the top of the towel to form a pocket, patches of hook fiber cloth secured to the top side of said flap at positions which register with hook fiber patches secured to the towel when said flap is folded over the top of the towel, whereby when said flap is folded over the patches on the flap pressed against the patches on the top of the towel, the flap may be detachably engaged.

* * * * *